US012214245B2

(12) United States Patent
Cotton

(10) Patent No.: US 12,214,245 B2
(45) Date of Patent: Feb. 4, 2025

(54) DYNAMIC EXERCISE DEVICE

(71) Applicant: C. John Cotton, Gillette, WY (US)

(72) Inventor: C. John Cotton, Gillette, WY (US)

(73) Assignee: C. John Cotton, Gillette, WY (US)

( * ) Notice: Subject to any disclaimer, the term of this patent is extended or adjusted under 35 U.S.C. 154(b) by 112 days.

(21) Appl. No.: 18/142,002

(22) Filed: May 1, 2023

(65) Prior Publication Data

US 2023/0264070 A1 Aug. 24, 2023

Related U.S. Application Data

(62) Division of application No. 17/172,594, filed on Feb. 10, 2021, now Pat. No. 11,679,296.

(51) Int. Cl.
*A63B 21/00* (2006.01)
*A63B 23/12* (2006.01)

(52) U.S. Cl.
CPC ..... *A63B 21/4035* (2015.10); *A63B 21/4049* (2015.10); *A63B 23/1236* (2013.01)

(58) Field of Classification Search
CPC ... A63B 19/00; A63B 19/04; A63B 21/00181; A63B 21/00185; A63B 21/002; A63B 21/0023; A63B 21/0428; A63B 21/0552; A63B 21/068; A63B 21/22; A63B 21/4035; A63B 21/4049; A63B 22/20; A63B 23/1236; A63B 26/00; A63B 26/003; A63B 71/0054; A63B 2071/0072; A63B 2208/0295
See application file for complete search history.

(56) References Cited

U.S. PATENT DOCUMENTS

| | | | |
|---|---|---|---|
| 2,819,081 | A | 1/1958 | Touraine |
| 3,384,370 | A | 5/1968 | Bailey |
| 3,868,786 | A | 3/1975 | Lippe |
| 4,618,143 | A | 10/1986 | Twardosz |
| 4,690,400 | A | 9/1987 | Metz |
| 4,822,035 | A | 4/1989 | Jennings |
| RE33,218 | E | 5/1990 | Twardosz |
| 5,024,434 | A | 6/1991 | Smith |
| 5,080,349 | A | 1/1992 | Vittone |
| 5,358,463 | A | 10/1994 | Fuentes |
| 5,399,133 | A | 3/1995 | Haber |
| 5,407,405 | A | 4/1995 | Oren |
| 5,718,654 | A | 2/1998 | Kennedy |
| 5,735,779 | A | 4/1998 | Lay |

(Continued)

OTHER PUBLICATIONS

The Spyder 360™, accessed and printed on Sep. 7, 2021 from website: https://thespyder360.com (13 pages).

(Continued)

*Primary Examiner* — Gary D Urbiel Goldner
(74) *Attorney, Agent, or Firm* — Corner Counsel, LLC

(57) ABSTRACT

A dynamic exercise device having a hand grip mounted in an inner ring, the inner ring mounted in an outer ring, and the outer ring mounted in a base. The inner ring, outer ring and base are each movable in at least one degree of freedom relative to each of the others. The base further includes a first support strut, a second support strut, and a bridge member interconnecting the first and second support struts and having a planar surface-engaging face configured to engage a surface on or against which the exercise device is used.

18 Claims, 8 Drawing Sheets

(56) References Cited

U.S. PATENT DOCUMENTS

| | | | | |
|---|---|---|---|---|
| 6,022,300 | A | 2/2000 | Hightower | |
| 6,702,723 | B2 | 3/2004 | Landfair | |
| 7,238,147 | B2 | 7/2007 | Mills | |
| 7,862,486 | B1 | 1/2011 | Watson | |
| 7,955,157 | B1 | 6/2011 | Hedeen, Jr. | |
| 8,672,815 | B1 | 3/2014 | Springer | |
| 8,845,500 | B2 | 9/2014 | Huang | |
| 9,067,104 | B1 | 6/2015 | Kim | |
| 9,358,419 | B1 | 6/2016 | Smith | |
| 10,029,140 | B2 | 7/2018 | Douglass | |
| 10,124,207 | B2 | 11/2018 | Artioli | |
| 10,639,516 | B2 | 5/2020 | Thomas | |
| 10,888,731 | B2 | 1/2021 | Olmstead | |
| 11,426,621 | B2 | 8/2022 | Bauerle | |
| 11,679,296 | B2 * | 6/2023 | Cotton | A63B 21/4049 482/141 |
| 2003/0207740 | A1 | 11/2003 | Fenelon | |
| 2005/0003931 | A1 | 1/2005 | Mills | |
| 2005/0187079 | A1 | 8/2005 | Diakonov | |
| 2005/0227831 | A1 | 10/2005 | Mills | |
| 2005/0250626 | A1 | 11/2005 | Charnitski | |
| 2006/0014615 | A1 | 1/2006 | Godbold | |
| 2006/0030463 | A1 | 2/2006 | Maloy | |
| 2006/0040809 | A1 * | 2/2006 | Godbold | A63B 23/14 482/141 |
| 2006/0160682 | A1 * | 7/2006 | Maloy | A63B 26/003 482/121 |
| 2008/0176723 | A1 | 7/2008 | Johnson | |
| 2009/0186751 | A1 | 7/2009 | Hauser | |
| 2009/0298656 | A1 | 12/2009 | Dannenberg | |
| 2010/0144502 | A1 | 6/2010 | Hinds | |
| 2010/0210431 | A1 | 8/2010 | Hinton | |
| 2010/0317496 | A1 | 12/2010 | Abranchess | |
| 2011/0287909 | A1 | 11/2011 | Morris | |
| 2012/0083396 | A1 | 4/2012 | Aquino | |
| 2012/0115688 | A1 | 5/2012 | Cen | |
| 2012/0202656 | A1 | 8/2012 | Dorsay | |
| 2013/0035218 | A1 | 2/2013 | Wierszewski | |
| 2013/0085046 | A1 | 4/2013 | Jolly | |
| 2013/0123079 | A1 | 5/2013 | Peritz | |
| 2013/0210577 | A1 | 8/2013 | Ceoldo et al. | |
| 2013/0217549 | A1 | 8/2013 | Marji | |
| 2013/0316886 | A1 | 11/2013 | Lynch | |
| 2014/0342882 | A1 | 11/2014 | Huang | |
| 2016/0175644 | A1 | 6/2016 | Agostini | |
| 2018/0185702 | A1 | 7/2018 | Brown | |
| 2018/0243605 | A1 | 8/2018 | Light | |
| 2019/0275365 | A1 | 9/2019 | Bongelli | |
| 2021/0178217 | A1 | 6/2021 | Ix | |
| 2022/0249903 | A1 * | 8/2022 | Cotton | A63B 21/4049 |
| 2023/0264071 | A1 * | 8/2023 | Cotton | A63B 21/4035 482/141 |

OTHER PUBLICATIONS

The Spyder 360™, The Way Back Machine, accessed and printed on Sep. 21, 2021 from http://web.archive.org/web/20180819171006/https:/thespyder360.com (12 pages).

* cited by examiner

DYNAMIC EXERCISE DEVICE

RELATED APPLICATION

This application is a divisional of U.S. patent application Ser. No. 17/172,594, filed Feb. 10, 2021, which is incorporated herein by reference in its entirety.

FIELD OF INVENTION

The invention relates to exercise devices and, more particularly, although not exclusively, to portable, dynamic exercise devices such as push up bars.

BACKGROUND

Prior art portable body weight exercise devices for the upper body and core allow for exercise of the muscles of the upper body in a limited range of motion and associated development of limited muscle groups. Prior art devices generally provide for primarily exercising the muscles of the chest (pectoralis major) and the core/abdomen with the hands in a fixed position or orientation (e.g. in a pronated or palms down position). Other prior art devices offer only a limited scope for movement or reorientation of the hands and wrist during performance of the exercise. Further, prior art devices generally allow only a limited range of adjustability to accommodate the vast range of human anatomical variation. Accordingly, use of prior art exercise devices may result in excessive stresses being placed on the wrist or elbow.

Further, prior art devices generally do not train the stabilizer muscles in the upper body (e.g., in the forearm, wrist, elbow, shoulder, etc.) to an extent proportional to the training of the chest and core muscles. Prior art devices may thereby neglect the training and development of stabilizer muscles of the upper body. Accordingly, use of prior art exercise devices may result in imbalanced muscle group development that adversely affects flexibility, strength, appearance and functionality, and may also contribute to injury.

Presently, there are believed to be no suitable dynamic, portable body weight exercise devices for the upper body and core that are safe, easy-to-use, and allow for exercise of virtually all of the muscles of the upper body in multiple ranges of motion, including the stabilizer muscles in the upper body (e.g. in the forearm, wrist, elbow, shoulder, etc.).

Thus, an exercise device capable of training and developing the stabilizer muscles of the upper body is desirable, so as to improve the development of multiple muscle groups.

SUMMARY

Embodiments of the present invention seek to provide solutions to the deficiencies identified above by providing multi-directional moving exercise devices allowing for exercise of virtually all of the muscles of a user's upper body in multiple ranges of motion, and associated development of multiple muscle groups by the user.

According to one embodiment of the invention, an exercise device comprises a base including a first support strut, a second support strut, and a bridge member interconnecting the first and second support struts and having a planar surface-engaging face configured to engage a surface on or against which the exercise device is used; and a handle having a first end and a second end opposite to the first end, a grip, an inner ring in which the grip is rotatably mounted, and an outer ring in which the inner ring is rotatably mounted, the handle being rotatably coupled to the base via a first bearing at the first end of the handle and a second bearing at the second end of the handle. The first bearing and the second bearing of the handle define a first axis about which the handle is configured to rotate relative to the base, the first axis being parallel with a surface. At least one of the first bearing and the second bearing comprises an adjustment element configured to selectively limit a degree of rotation of the handle about the first axis. One of the inner ring and the outer ring comprises an annular rail which is captive within a slot formed in the other of the inner ring and the outer ring, the annular rail being sized to slide freely around the slot about the second axis.

According to another embodiment of the invention, an exercise device comprises a base including a first support strut, a second support strut, and a bridge member interconnecting the first and second support struts and having a planar surface-engaging face configured to engage a surface on or against which the exercise device is used; and a handle having a first end and a second end opposite to said first end, a grip, an inner ring in which the grip is rotatably mounted, and an outer ring in which the inner ring is rotatably mounted, the handle being rotatably coupled to the base via a first bearing at the first end of the handle and a second bearing at the second end of the handle. The first bearing and the second bearing of the handle define a first axis about which the handle is configured to rotate relative to the base, the first axis being parallel with the surface. At least one of the first bearing and the second bearing comprises a first adjustment element configured to selectively limit a degree of rotation of the handle about the first axis. One of the inner ring and the outer ring comprises an annular rail which is captive within a slot formed in the other of the inner ring and the outer ring, the annular rail being sized to slide freely around the slot about the second axis. The inner ring rotates in the outer ring about a second axis which is perpendicular to the first axis. The inner ring comprises a second adjustment element which limits a degree of rotation of the grip about the second axis.

According to yet another embodiment of the invention, an exercise device comprises a base including a first support strut, a second support strut, and a bridge member interconnecting the first and second support struts and having a planar surface-engaging face configured to engage a surface on or against which the exercise device is used; a handle having a first end and a second end opposite to said first end, a grip, an inner ring in which the grip is rotatably mounted, and an outer ring in which the inner ring is rotatably mounted, the handle being rotatably coupled to the base via a first bearing at the first end of the handle and a second bearing at the second end of the handle; and a web, the web configured to join the annular rail to a remainder of the base, and to the first and second support struts.

The first bearing and the second bearing of the handle define a first axis about which the handle is configured to rotate relative to the base, the first axis being parallel with the surface. At least one of the first bearing and the second bearing comprises an adjustment element configured to selectively limit a degree of rotation of the handle about the first axis. One of the inner ring and the outer ring comprises an annular rail which is captive within a slot formed in the other of the inner ring and the outer ring, the annular rail being sized to slide freely around the slot about the second axis.

The exercise device may be portable, so that it can be put away by a user after an exercise session.

At least one of the first and second bearings may comprise a plain bearing. At least one of the first and second bearings may comprise a sleeve or bush. At least one of the first and second bearings may comprise a needle roller bearing. At least one of the first and second bearings may comprise a ball bearing. At least one of the first and second bearings may comprise a self-lubricating bearing.

The first bearing and the second bearing may comprise an adjustment element configured to selectively control a degree of rotation of the handle about the first axis or the resistance required to cause rotation of the handle about the first axis. The adjustment element may comprise a locking or limiting element such a pin, a bolt or a screw. The adjustment element may pass through or into one component to limit movement of another component or may engage two or more components to lock them together in a desired relative position or orientation.

The base may comprise a plurality of rotatable elements configured to translate and/or rotate the exercise device relative to the surface against which the device is used. The rotatable elements may, for example, comprise wheels, ball rollers or castors.

The handle may comprise a grip configured to be grasped by a user. The grip may be elongated and may have a profiled surface to improve grip.

The handle may comprise an inner ring in which the grip is mounted. The grip may be rotatably mounted in the inner ring. Optionally, the inner ring may be integrally formed with the grip. For example, they may be molded in one piece.

The handle may further comprise an outer ring, the inner ring being rotatably mounted in the outer ring. The inner ring may rotate in the outer ring about a second axis which is perpendicular to said first axis.

The inner ring may be arcuate or annular. The inner ring may provide structural support, to reduce flexing of the grip. The inner ring may be shaped to accommodate a first of a user gripping the grip.

The present invention may thereby offer multiple advantages over prior art devices. According to the embodiments of the invention disclosed herein, an exercise device may be provided that accommodates differences in grip angle throughout the full range of motion of an exercise, irrespective of the anatomy of a user, and can accommodate the vast range of human anatomical variation. The exercise device can increase development of a user's stabilizer muscles due to the rotational freedom of the handle relative to the surface against which the device is used. The exercise device can also provide at least two degrees of freedom of rotation, and translation such that additional training stimuli are provided.

DETAILED DESCRIPTION

Figure 1A:
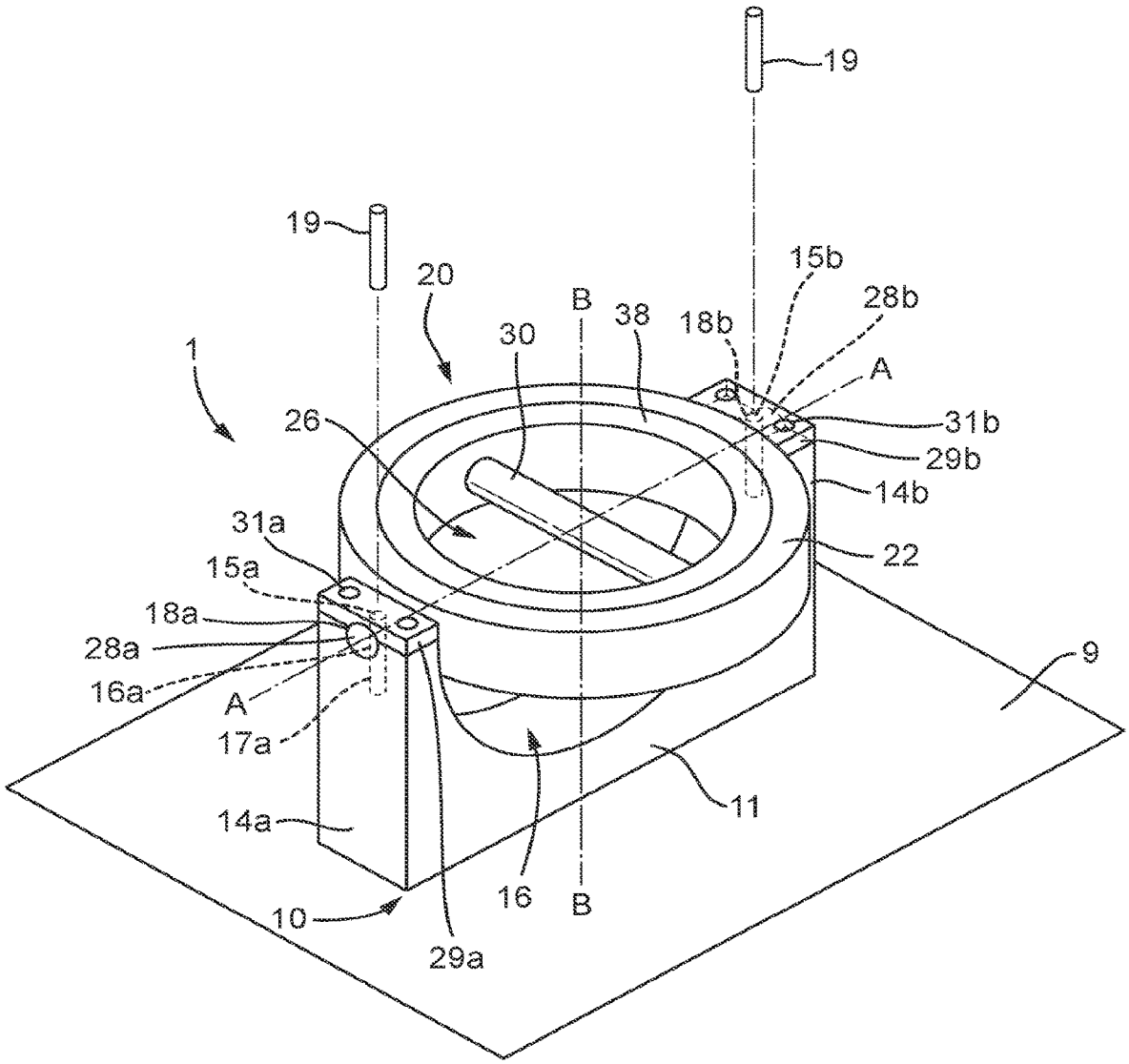
FIG. 1A is a top perspective view of an embodiment of an exercise device according to the present invention.

With reference to FIGS. 1A, 1B, 1C, 1D and 1E, collectively FIG. 1, an embodiment of the invention is disclosed as exercise device 1. Exercise device 1 is configured to be used by a user in order to perform physical training exercises against a surface (e.g., a floor, wall, inclined surface, etc.). In various embodiments, the exercise device 1 may be engaged by a user's hand or foot. Optionally, and according to the user's preference and selected exercise, a user may choose to use two exercise devices, one for each hand or one for each foot. Optionally, and according to the user's preference and selected exercise, a user may choose to use four exercise devices 1, one per limb, such that each of the user's hands and feet may be engaged to an exercise device 1. The exercise device 1 may be portable (e.g., readily manipulatable and movable by a single user, and easy to put away after use) and dynamic (e.g. comprising parts which move, articulate or rotate during use), as further described below.

Exercise device 1 principally comprises a support member 10 (also referred to as a "base" or "cradle") and a handle 20.

In an embodiment, base 10 comprises a first support strut 14 *a*, a second support strut 14 *b*, interconnected by a bridge member 11. The first support strut 14 *a*, second support strut 14 *b*, and bridge member 11, may be integrally formed, for example by being molded in one piece, or may comprise separate components connected by fixing elements such as rivets, bolts or screws. Bridge member 11 has a surface-engaging face 12 configured to engage a surface 9 (e.g. a floor, a wall or an inclined surface) on or against which the exercise device 1 is used. Base 10 is shaped to accommodate handle 20 at least partially therein by having a recessed upper surface 16.

In the embodiment of FIG. 1, a first arcuate bearing surface 18 *a* is formed in the first support strut 14 *a* and a second arcuate bearing surface 18 *b* is formed in the second supporting strut 14 *b*. The first bearing surface 18 *a* and the second bearing surface 18 *b* are configured to receive corresponding bearing members 28 *a*, 28 *b* (also referred to as "trunnions") provided on the handle 20. In the embodiment of FIG. 1, the trunnions 28 *a*, 28 *b* are held in place on the first and second bearing surfaces 18 *a*, 18 *b* by first and second bearing caps 29 *a*, 29 *b*, which are fixed to the first and second support struts 14 *a*, 14 *b* by fixing elements such as bolts 31 *a*, 31 *b*. Other forms of connection are contemplated, such as snap fit connections or by providing a support strut 14 *a* which fully encloses the trunnion 28 *a* at only one end of the handle 20, the trunnion 28 *b* at the other end of the handle being inserted into a bore formed in the second support strut 14 *b* at the other end of the handle.

The handle 20 comprises an outer ring 22, an inner ring 38, and an elongated gripping portion 30 (also referred to as "grip") within the inner ring 38. The handle 20 is aligned with the first trunnion 28 *a* provided at a first location on a radially outer surface (e.g. circumference) of the outer ring 22 and the second trunnion 28 *b* is provided on a second (e.g. opposing) location of the radially outer surface of the outer ring 22. In this embodiment, the first and second trunnions

28 *a*, 28 *b* are provided 180 degrees apart on an axis A-A which passes through the first and second trunnions 28 *a*, 28 *b* of the handle 20, and bisects the outer ring 22.

The first and second trunnions 28 *a*, 28 *b* of the handle 20 are mounted on and rotatably engage the corresponding first and second bearing surfaces 18 *a*, 18 *b* of the support member 10 and are retained against the bearing surfaces 18 *a*, 18 *b* by the bearing caps 29*a*, 29*b*. In this way, the handle 20 is supported in the base 10 and is rotatable, relative to the base 10, about the axis A-A. In this embodiment, the rotational axis A-A is parallel to the surface-engaging face 12 of the base 10, such that the handle 20 is rotatable relative to the surface 13 on which the device 1 is used, about an axis which is parallel to the surface 9. The handle 20 may be rotatable through 360 degrees about the axis A-A or may be rotatable only within a predetermined range.

Any suitable form of bearing, such as a bush, bearing sleeve of high lubricity material, needle roller bearing or ball bearing, may be interposed between the trunnions 28*a*, 28*b* and the bearing surfaces 18*a*, 18*b*, or form all or part of the trunnions 28*a*, 28*b*, and/or bearing surfaces 18*a*, 18*b*.

The inner ring 38 is mounted concentrically within the outer ring 22. The inner ring 38 engages a radially inner surface (not indicated in the Figures) of the outer ring 22 such that the inner ring 38 is rotatably mounted in the outer ring 22. In the embodiment of FIG. 1, and particularly as shown in FIGS. 1C and 1E, the radially inner surface of the outer ring 22 of the handle 20 comprises a continuous annular slot 41 which is T-shaped in cross section. The slot 41 receives a plurality of projections 43 which are fixed to and spaced around the inner ring 38 and project radially outwardly from the inner ring 38 into the slot 41 in the outer ring 22. Optionally, the projections 43 may be replaced by a continuous arcuate rail which extends radially outwardly into the slot 41. The projections or arcuate rail 43 are sized to slide within the slot 41, so that the inner ring 38 can rotate relative to the outer ring 22, the rail and slot forming a sliding bearing arrangement. In one example, the outer ring 22 is formed in two halves which are connected together by fixings such as bolts or screws or by a snap fit connection. In order to assemble the handle 20, the two halves of the outer ring 22 are placed on opposite sides of the projections or annular rail 43 of the inner ring 38, such that the projections or annular rail 43 of the inner ring 38 are trapped within the continuous slot 41 of the outer ring 22. The two halves are then connected by the fixings.

The inner ring 38 defines a circular opening 26. The grip 30 spans the circular opening 26 of the inner ring 38 and may be fixed to the inner ring 38 at both ends. In another embodiment, the grip 30 is rotatably mounted in a radially inner wall 47 of the inner ring 38. For example, the grip 30 may extend through openings 45 formed in the radially inner wall 47. The grip 30 is shaped to be grasped by a user 2 when using the exercise device 1, and the circular opening 26 is shaped and sized to accommodate a hand (e.g. a clenched first) of a user 2 of the exercise device 1. Of course, as noted earlier, the circular opening 26 is also large enough to accommodate a user's foot on either side of the grip 30.

The grip 30 is coupled to the inner ring 38 and is rotatable relative to the outer ring 22 of the handle 20 by means of the rotatable engagement between the inner ring 38 and the outer ring 22. The grip 30 is therefore rotatable relative to the outer ring 22 of the handle 20. For example, the grip 30 may be rotatable within the handle 20 about an axis B-B which is perpendicular to a diameter of the outer ring 22 of the handle member 20. The axis B-B may pass through at least one of: the midpoint of the grip 30; and the center of the outer ring 22. The grip 30 may be rotatable through a full 360 degrees about the axis B-B. It will therefore be understood that the axis B-B, about which the grip 30 rotates, is fixed relative to the handle 20. However, as the handle 20 is rotatable about the axis A-A relative to the base 10, the axis B-B is itself rotatable about the axis A-A and relative to the base 10, such that rotation of the handle 20 causes axis B-B to rotate.

Accordingly, the handle 20 is rotatable relative to the base 10, and thus is also rotatable relative to the surface 9 on which the device 1 is placed, about an axis A-A parallel to the surface on which the device 1 is placed. Further, the grip 30 is rotatable relative to the handle 20 about an axis B-B perpendicular to the axis A-A about which the handle member 20 is also rotatable. Grip 30 may also be configured to rotate along its own long axis relative to all the other elements of the device, as can be readily understood by those skilled in the art.

The above-described axes of rotation permit the exercise device 1 to adopt the variety of alignments shown in FIGS. 1A to 1D, and others, as readily understood.

Figure 1B:
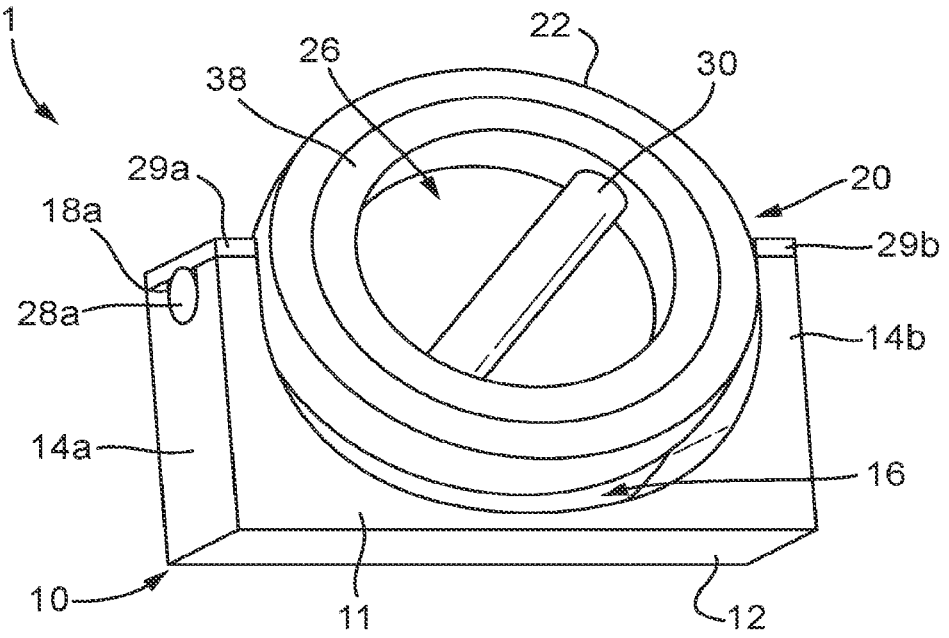
FIG. 1B is a bottom perspective view of the exercise device of FIG. 1A.
Figure 1C:
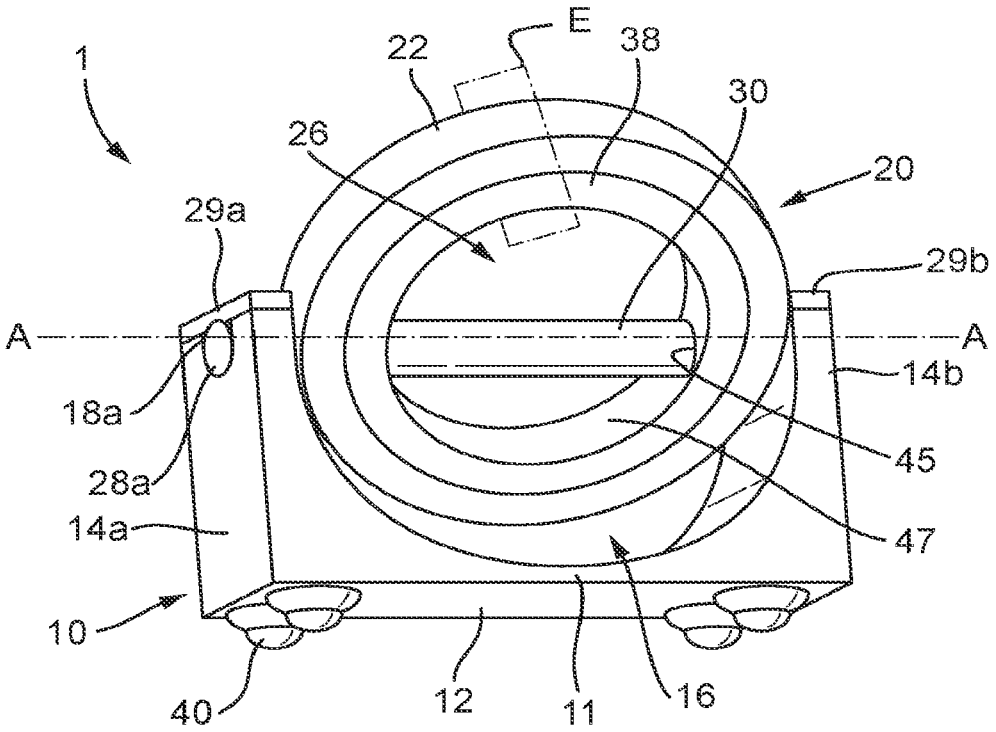
FIG. 1C is a bottom perspective view of another embodiment of the exercise device of FIG. 1A.

The embodiment of FIG. 1C is identical to the embodiment of FIGS. 1A and 1B except that the base 10 is provided with a plurality of feet 40, which may, for example comprise wheels, ball rollers or castors. The feet 40 are provided on the surface-engaging face 12 of the base 10, such that the feet 40 engage the surface 9 against which the device 1 is used. The feet 40 may simply provide a stability to the base and prevent it from sliding easily across the surface 9 or may optionally facilitate the device 1 translating across, and rotating relative to, the surface 9 against which the device 1 is used.

Each of the plurality of feet 40 may be multi-directionally rotatable, such that the device 1 may translate across the surface in any direction. For example, one or more of the plurality of rotatable elements 40 may comprise a spherical rotatable element, such as a ball roller or a castor. Alternatively, one or more of the plurality of rotatable elements 40 may be rotatable in only one direction. For example, one or more of the plurality of rotatable elements may comprise a wheel having a fixed orientation relative to the base 10. Alternatively, one or more of the feet 40 may not be rotatable, and may for example comprise rubber or plastic buffers which resist sliding of the base 10 on the surface 9 and may also provide shock absorption in vigorous use of the exercise device 1.

Figure 1D:
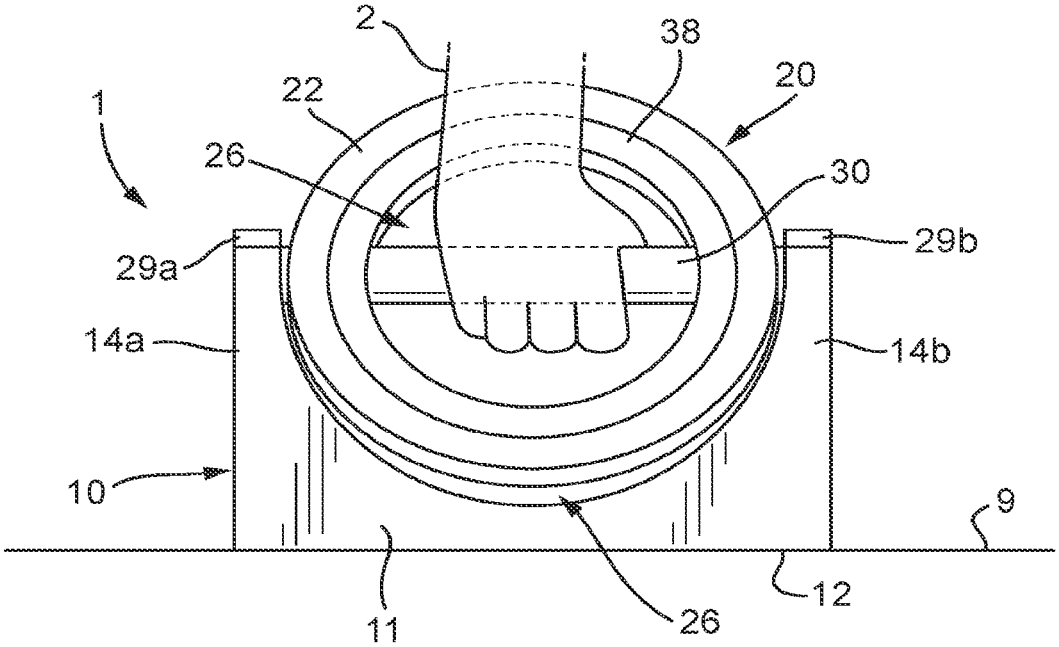
FIG. 1D is a side perspective view of the exercise device of FIG. 1A showing the handle gripped by a user's hand.
Figure 1E:
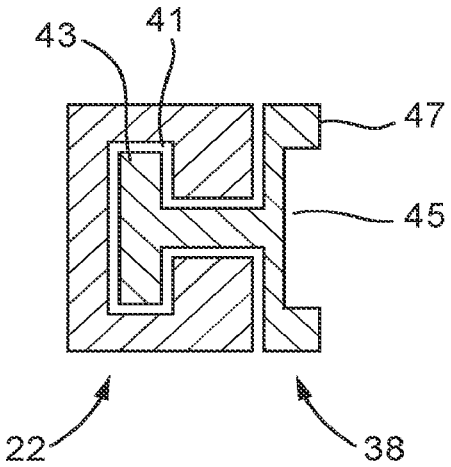
FIG. 1E is a cross-section through the handle of FIG. 1C.

In use, as shown in FIG. 1D, a user 2 of the exercise device 1 grasps the grip 30 in order to use the exercise device 1 as an exercise aid. For example, a user 2 may use a pair of exercise devices 1 in order to perform push-ups. The user 2 rotates the grips 30 within the handle 20 until a suitable angle is found for his or her anatomy and the chosen exercise. When performing an exercise using the exercise device 1, the user 2 will exert a force on the grip 30. The one or more rotational freedoms of the grip 30 relative to the base 10 ensure that during use, as the direction and magnitude of force exerted by the user on the grip 30 varies, at least one of the grip 30 and the handle 20 will rotate relative to the base 10. For example, during the course of completing a push-up, the direction and magnitude of the force exerted by the user 2 on the device 1 will vary. The user must thereby stabilize and/or correct for the angle of the forces using his/her stabilizer muscles in the upper body, in order to maintain the grip 30 in a stable position against which forces can be exerted. Accordingly, the various degrees of rotational freedom of components of the exercise device 1, and the optional mobility of the exercise device 1 via feet 40, encourages the user to develop stabilizer muscles in order to maintain the grip 30 steady.

Each of the areas of the exercise device 1 in which there is relative motion, (e.g., optionally between the base 10 and the handle 20, between the inner ring 38 and outer ring 22 of the handle 20 and between the grip 30 and the inner ring 38) may comprise an adjustment element, such as a range limiting pin which physically limits the range of motion. Further, one or more of the feet 40 may have an adjustment element. The adjustment element may also allow a user of the device 1 to selectively adjust the resistance or friction settings (e.g., on, off or within a predetermined range) of each of the above described areas of relative motion. For example, the adjustment element may allow the user to "lock" a particular area of relative motion or dynamic feature, such that the feature may not be able to rotate or translate. The adjustment element may also allow the user to control the resistance at one or more of the areas of relative motion to determine the degree of stabilizer muscle recruitment and training during performance of an exercise. With reference to FIG. 1A, an example of an adjustment element is shown. The first and second bearing caps 29 *a*, 29 *b* comprise bores 15 *a*, 15 *b* formed centrally in the bearing cap and extending in a direction parallel to the fixing bolts 31 *a*, 31 *b* and perpendicular to the axis A-A. The bores 15 *a*, 15 *b* are aligned with corresponding threaded blind bores 17 *a*, 17 *b* formed in the first and second support struts 14 *a*, 14 *b*. Trunnions 28 *a*, 28 *b* have at least one, but preferably multiple, corresponding through bores 16 *a*, 16 *b* (not shown) radially arranged therethrough perpendicular to axis A-A at any desired angular spacing, such as every 30 degrees. Bores 15 *a*, 15 *b*, 16 *a*, 16 *b* and 17 *a*, 17 *b* are all sized to receive an elongated element such as a rod or pin 19 therethrough. When bores 15 *a* and 17 *a* for example, are co-axial with a corresponding bore 16 *a* in trunnion 28 *a*, and a pin 19 is inserted through both bores 15 *a*, 16 *a*, this will lock the orientation of outer ring 22 relative to base 10.

Although this embodiment describes the use of two adjustment elements (comprising a locking pin arrangement), one in both support struts 14 *a*, 14 *b*, in an alternative embodiment (not illustrated) the adjustment element may be provided in only one support strut.

In another example, a user of the device 1 may wish to use two devices 1 as stationary, fixed push-up bars, in which case the adjustment elements of the device 1 may all be locked out such that they cannot rotate, for example by use of pins inserted through aligned bores in the components being locked together, as in the previous embodiment.

In another embodiment, a user of the device 1 may wish to improve the stability of his/her wrist only, in which case, if the feet 40 comprise rotatable elements such as wheels or castors, they may also be locked, for example using pins inserted through aligned bores in the rotating elements and their respective mountings, or through other means known in the art. Furthermore, the grip 30 may be prevented from rotating relative to the handle 20 by use of similar locking or range limiting adjustment elements, such as the locking pin arrangements described above. In this locked configuration, only the handle 20 may be capable of rotating relative to the base 10 about the axis A-A.

In a further example, a user of the device 1 may wish to maximally train his/her stabilizer muscles, in which case all of the adjustment elements will be unlocked or set to their maximum range of motion.

It should be understood that the features of the grip 30 and the handle 20, including their freedom to rotate about axes B-B and A-A respectively, may be common to each of the embodiments of the present invention. For example, as shown in the Figures, each of the embodiments may comprise a handle 20 having a grip 30, the handle 20 being rotatable relative to the base 10 about an axis A-A, and the grip 30 may be rotatable relative to the handle 20 about an axis B-B. Further, each of the embodiments of the present invention may comprise the feet 40 described above in relation to the first embodiment. For conciseness and ease of understanding, the above features shall not be described explicitly in relation to each embodiment but should be considered to be present and operate as described in relation to the exercise device 1. It is generally the features of the base 10 which vary throughout the embodiments.

With reference to an alternative embodiment depicted in FIGS. 2A, 2B, 2C and 2D, collectively FIG. 2, an exercise device 101 comprises a top portion 101 *a* and a bottom portion 101*b* (also referred to as a "stand").

The top portion 101*a* of the exercise device 101 is largely analogous to the exercise device 1 of FIG. 1. The top portion 101 *a* comprises a base 110, a handle 120, and a grip 130. The interconnections and bearing arrangements between the base 110, the handle 120, and the grip 130 may be identical to the interconnections and bearing arrangements between the corresponding features and components of the exercise device 1 of FIG. 1. For example, the handle 120 may be rotatable relative to the base 110 about an axis in parallel with the surface-engaging face 112 of the base 110 by means of a pair of trunnions 128*a*, 128*b* provided at opposing ends of the handle 120 and configured to rotatably engage corresponding bearing housings 121*a*, 121*b* provided in first and second support struts 114*a*, 114*b*. Further, the grip 130 may be rotatable relative to the handle 120, about an axis which is perpendicular to a longitudinal axis A-A of the handle 120, by means of a pair of bearing arrangements, such as plain bearings provided at opposing ends of the grip 130. However, the top portion 101*a* of the exercise device 101 of FIG. 2 differs from the exercise device 1 of FIG. 1 in that the base 110 of the exercise device 101 comprises a rail 113 and a web 115.

Figure 2A:
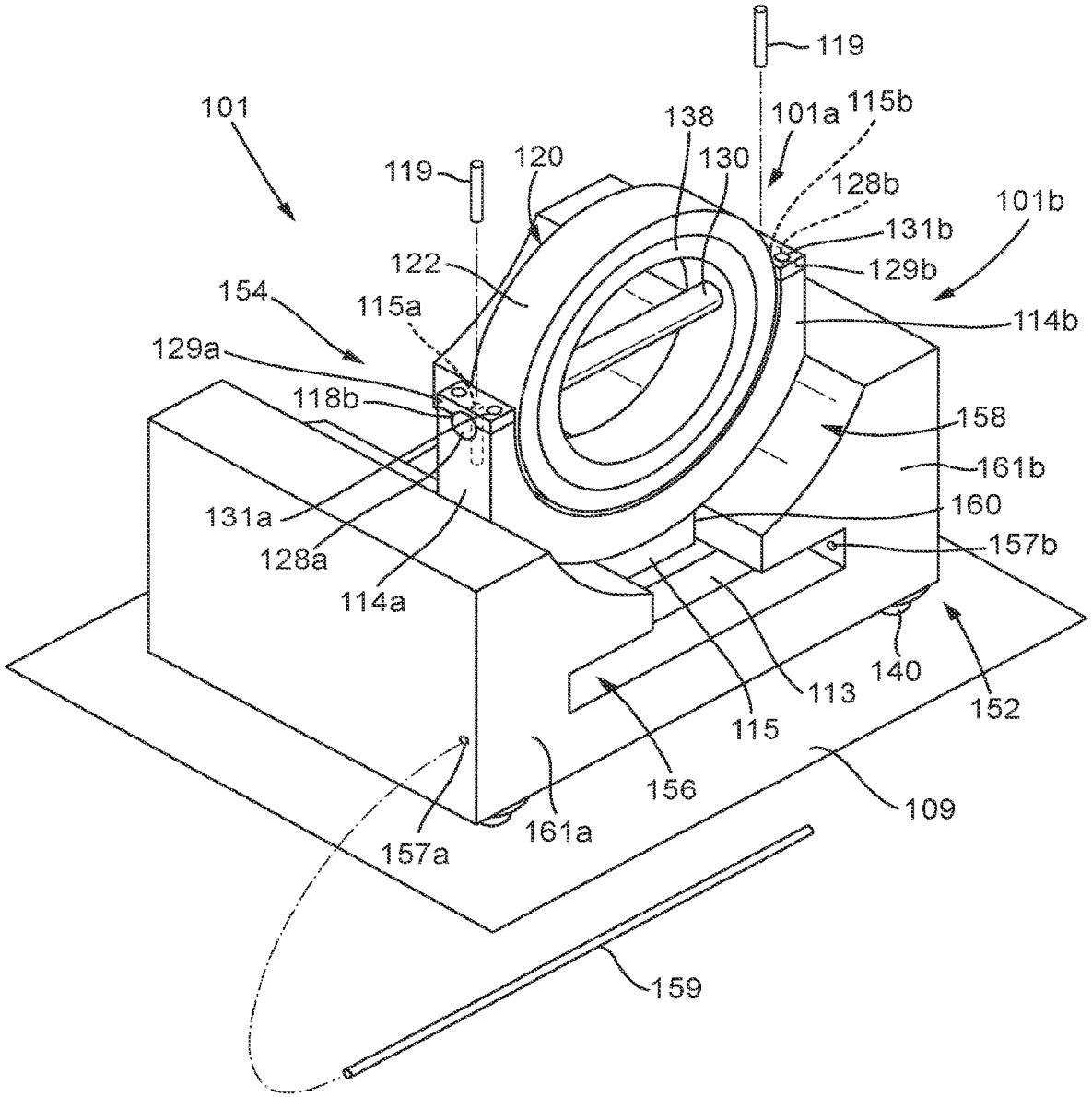
FIG. 2A is a top perspective view of another embodiment of an exercise device.
Figure 2B:
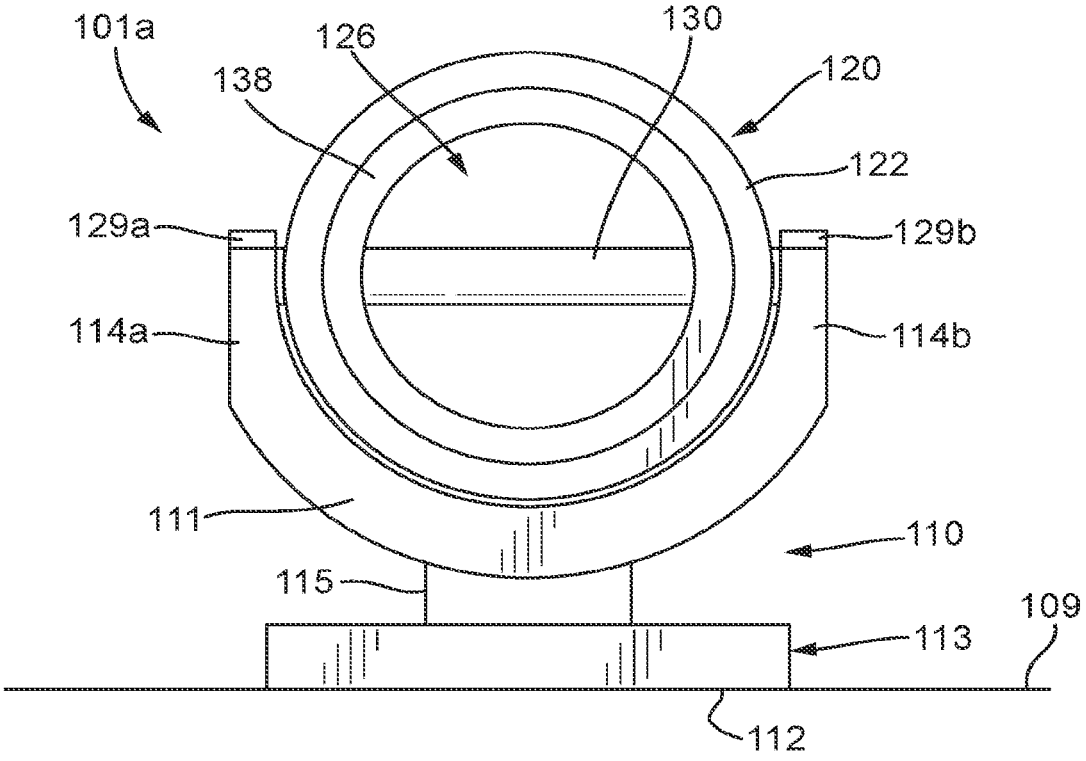
FIG. 2B is a front view of the top portion of the exercise device of FIG. 2A.

In this embodiment, the rail 113 has a substantially planar, uniform (e.g., rectangular) cross section, such that the front view shown in FIG. 2B is representative of the cross section along the whole length of the rail 113. The rail 113 is sized to ensure that the top portion 101 *a* of the device 101 is a stable during use. On its lowermost surface, the rail 113 comprises a support face 112.

The rail 113 is joined to the remainder of the base 110, and the first and second support struts 114 *a*, 114 *b*, by a web 115. The web is substantially narrower and may be shorter than the rail 113. The web 115 may be provided part way (e.g. half-way) along the rail 113. For example, the web 115 may be centered on a midpoint of the rail 113.

As with the embodiment of FIG. 1, which has a surface-engaging face 12, a support face 112 of the base is configured to engage a surface 109 on or against which the top portion 101*a* of the device 101 is placed during use, such that a user of just the top portion 101*a* may be provided with a stable platform against which to exert force.

Figure 2C:
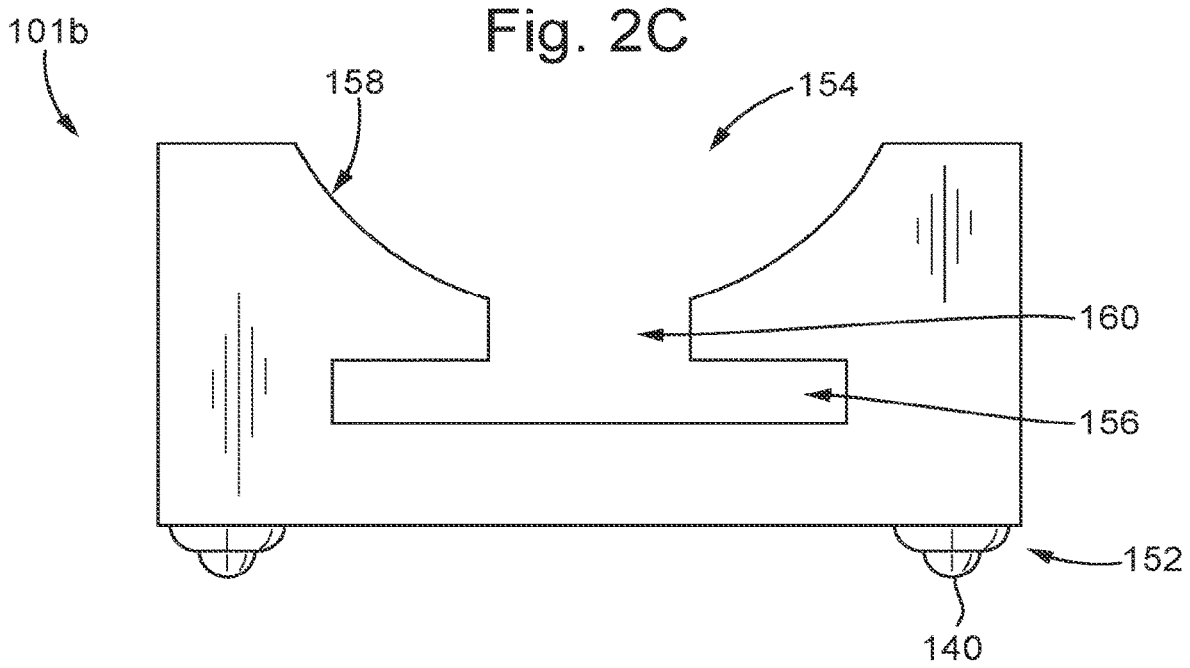
FIG. 2C is a front view of the bottom portion or stand of the exercise device of FIG. 2A.
Figure 2D:
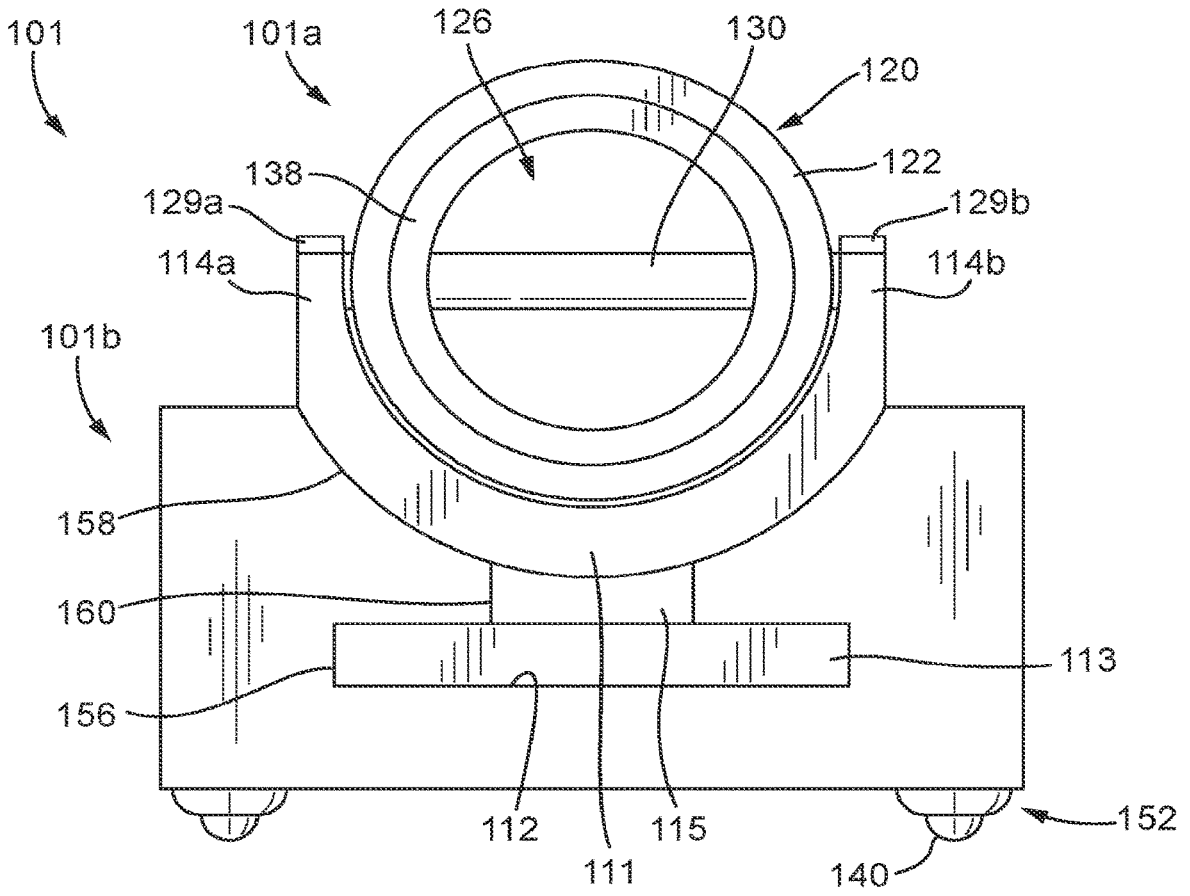
FIG. 2D is a front view of the exercise device of FIG. 2A.

The bottom portion or stand 101 *b* of the device 101 acts as a support stand for the top portion 101*a* and comprises a recess 154 which opens into a channel 156. The recess 154 and channel 156 are sized to cooperatively receive the first and second support struts 114*a*, 114*b* of the top portion 101*a*. The recess 154 comprises a slot 160, which extends into the channel 156. The slot 160 is sized to receive the web 115 of the top portion 101*a*. The recess 154, the channel 156 and the slot 160, have a uniform cross section, such that the side view shown in FIG. 2C is generally representative of the cross section along the length of the stand 101*b*.

The stand 101*b* may comprise a plurality of feet 140 which may comprise rotatable elements which facilitate movement of the exercise device 101 relative to the surface 113 against which the device 101 is used. Each of the plurality of rotatable elements 140 may be multi-directionally rotatable, such that the device 101 may translate across the surface 109 in any direction. For example, each of the plurality of rotatable elements 140 may comprise a spherical rotatable element (ball roller) or a castor. Alternatively, each of the plurality of rotatable elements 40 may be rotatable in only one direction. For example, each of the plurality of rotatable elements may comprise a wheel having a fixed orientation. Alternatively, two of the plurality of rotatable elements 140, for example on one end of the stand 101*b*, may be rotatable in only one direction (for example, these two rotatable elements may comprise wheels having a fixed orientation) and two of the plurality of rotatable elements 140, for example on an opposite end of the stand 101*b*, may comprise spherical rotatable elements or castors. This would provide an additional degree of restraint to translation in a direction parallel to an axis of rotation of the wheels but would allow the stand 101*b* to move in a direction perpendicular to the axis of rotation of the wheels. Thus, if a user aligns the stand 101*b* such that the wheel axes are generally perpendicular to the axis A-A, the wheels will provide resistance to the stand 101*b* sliding away forwards, but would allow sliding of the stand 101*b* to the side. This provides a way of training specific muscles simply by how the wheels are aligned relative to the grip 130.

Alternatively, the feet 140 of the stand 101*b* may not comprise rotatable elements 140 but may instead be replaced with non-rotatable elements such as low friction sliding pads, high friction feet or non-rotatable elements providing any level of stability between these extremes.

Alternatively, the user may be able to select from any combination of different rotatable elements 140 and non-rotatable elements (not shown), which can be supplied with the exercise device 101 or purchased separately. For example, the device may be supplied with a complete set of castors, a complete set of wheels, and a complete set of non-rotatable elements each provided with a bayonet fitting which can be releasably plugged into corresponding receiving sockets in the stand 101*b*. The user may then choose the degree of stability provided by the exercise device 101*b*, and for example start off using the device with maximum stability (for example by fitting non-rotatable elements such as rubber feet in each socket), then move on to less stability with wheels, then a combination of wheels and castors or wheels and ball rollers, and finally move on to minimum stability using all casters or ball rollers, as their physique develops.

The top portion 101*a* may be received in the stand 101*b* by sliding the top portion 101*a* into the recess 154 of the stand 101 *b* from one end of the stand 101*b*. In the same motion, the rail 113 of the top portion 101*a* will slide into the channel 156 of the stand 101*b*. The recess 154 and channel 156 are sized such that, upon insertion, the base 110 is cooperatively received within the slot 160 and channel 156. For example, upon insertion, exterior surfaces of the base 110 may be substantially contiguous with walls of the slot 160 and channel 156.

The length of the rail 113 and the length of the channel 156 may be equal. Alternatively, the length of the channel 156 may be greater than the length of the rail 113. For example, as shown in FIG. 2A, the channel 156 may be approximately twice as long as the rail 113. Various other embodiments are also readily contemplated.

As with the exercise device 1, the exercise device 101 may be used individually, or in pairs, depending on the exercise undertaken and a preference of the user. In a first mode of use, the top portion 101 *a* may be used without (e.g., independently of) the stand 101 *b*. The rail 113, and in particular the support face 112 thereof, may be placed on/against a surface 109 (e.g., floor, wall, etc.) against which the device is to be used. The support face 112 engages the surface 109 to provide a stable platform for the top portion 101*a*. The stand 101*b* of the device 101 may be temporarily set aside when in the first mode of use. A user of the device 101 may then use the top portion 101*a* in the same manner as the device 1. For example, the user may grasp the grip 130 in order to perform an exercise (e.g., press-ups, dips, etc.). The rotational freedom and mobility of the grip 130 and the handle 120 promote the recruitment and training of stabilizer muscles of the user in order to maintain the grip 130 and the handle 120 steady and in a constant position and orientation.

In a second, alternative mode of use, the top portion 101 *a* may be inserted into the stand 101 *b* such that the top portion 101*a* and the stand 101*b* are unified and used together. A user of the device 101 may then use the device in the same manner as exercise device 1. For example, the user may grasp the grip 130 in order to perform an exercise. The rotational freedom and mobility of the grip 130 and the handle 120 promotes the recruitment and training of stabilizer muscles of the user in order to maintain the grip 130 and the handle 120 steady and in a constant position and orientation.

In the example that the channel 156 is substantially longer than the rail 113, upon insertion within the channel 156, the rail 113 is afforded a degree of freedom to slide within the channel 156. The top portion 101*a* may thereby translate linearly relative to the stand 101*b* by sliding along the channel 156. In this manner, inserting the top portion 101*a* into the stand 101 *b* may confer an additional degree of freedom (e.g. translational freedom) on the gripping portion 130 and handle 120 relative to the stand 101*b*. Accordingly, a user may adopt the second mode of use in order to provide an additional training stimulus.

Optionally, the stand 101*b* may comprise rotatable elements 140, but the top portion 101*a* may not, because a user of the device 101 can adopt the second mode of use in order to add in multi-directional translational degrees of motion to the exercise device 101. For example, the rotatable elements 140 on the stand 101*b* allow the device 101 to slide in any direction along the surface on which the device 101 is used. The second mode of use may thereby confer an additional degree of freedom (e.g., multi-directional translational freedom) on the grip 130 and handle 120, such that a user is provided with additional training stimuli.

As described in relation to the exercise device 1, the exercise device 101 may comprise an adjustment element between the components which can move relative to one another. For example, the bearing assemblies between the base 110 and the handle 120, and the bearing assemblies between handle 120 and the grip 130 may comprise an adjustment element. Further, the rotatable elements 140 may each, or collectively, comprise an adjustment element. The adjustment elements may allow a user of the device 101 to selectively adjust the resistance or friction settings (e.g., on, off or set within a predetermined range). For example, the adjustment element may allow the user to "lock" components together to prevent relative movement between them, for example using the locking pin arrangements described above. Optionally, the adjustment element may allow the user to control the resistance of each of the bearing arrangements/assemblies or rotatable elements, or some or all of them, to provide the desired degree of stabilizer muscle recruitment and training during performance of an exercise. For example, in another embodiment, an elastic band (not shown) may be stretched open and placed around the stand 101*b* to close off channel 156. In this configuration, the elastic band will provide gradually increasing resistance to movement of the top portion 101*a* relative to the stand 101*b* as the center of the rail 113 slides further from the center of the channel 156.

Optionally, the channel 156 may comprise a plurality of stops, for example formed by pins which block the channel 156, to selectively control the range of sliding motion of the rail 113 relative to the channel 156. The stops may be provided at regular intervals along the channel 156 in order to stop or limit the motion of the rail 113 along the channel 156. Thus, the user may either lock the rail in a desired position along the channel 156, or alternatively define limits between which the rail 113 may be permitted to slide. In this manner, a user of the device 101 may be able to gradually increase the complexity and variability of the exercise such that his/her stabilizer muscles may be trained proportionately within their existing capacity, without risking injury.

An example of such a stop is shown in FIG. 2A. The stand 101*b* comprises a first bore 157*a* and a second bore 157*b* formed through opposing side walls 161*a*, 161*b* of the channel 156. The first and second bores 157*a*, 157*b* are coaxial and are sized to receive a pin 159 (not shown), which, upon insertion, obstructs the channel 156 in order to limit the range of motion of the rail 113 along the channel 156. The first bore 157*a* extends through the thickness of the wall 161*b* of the stand 101*b*, such that the pin 159 can be inserted through the wall 161*b* of the stand 101*b* towards the second bore 157*b* in the wall 161*a*. With the pin 159 in place, the channel 156 is obstructed and the rail 113 cannot move past the pin 159 and be ejected from the channel 156 during use of the exercise device. If a second pin is inserted in corresponding bores formed in the opposite end of the walls 161*a* and 161*b*, a second pin (not shown) can be pushed through the corresponding bores to provide a second limit stop, so that the rail 113 becomes captive in the channel 156 and can only slide backwards and forwards between the limit stop pins.

Figure 3A:
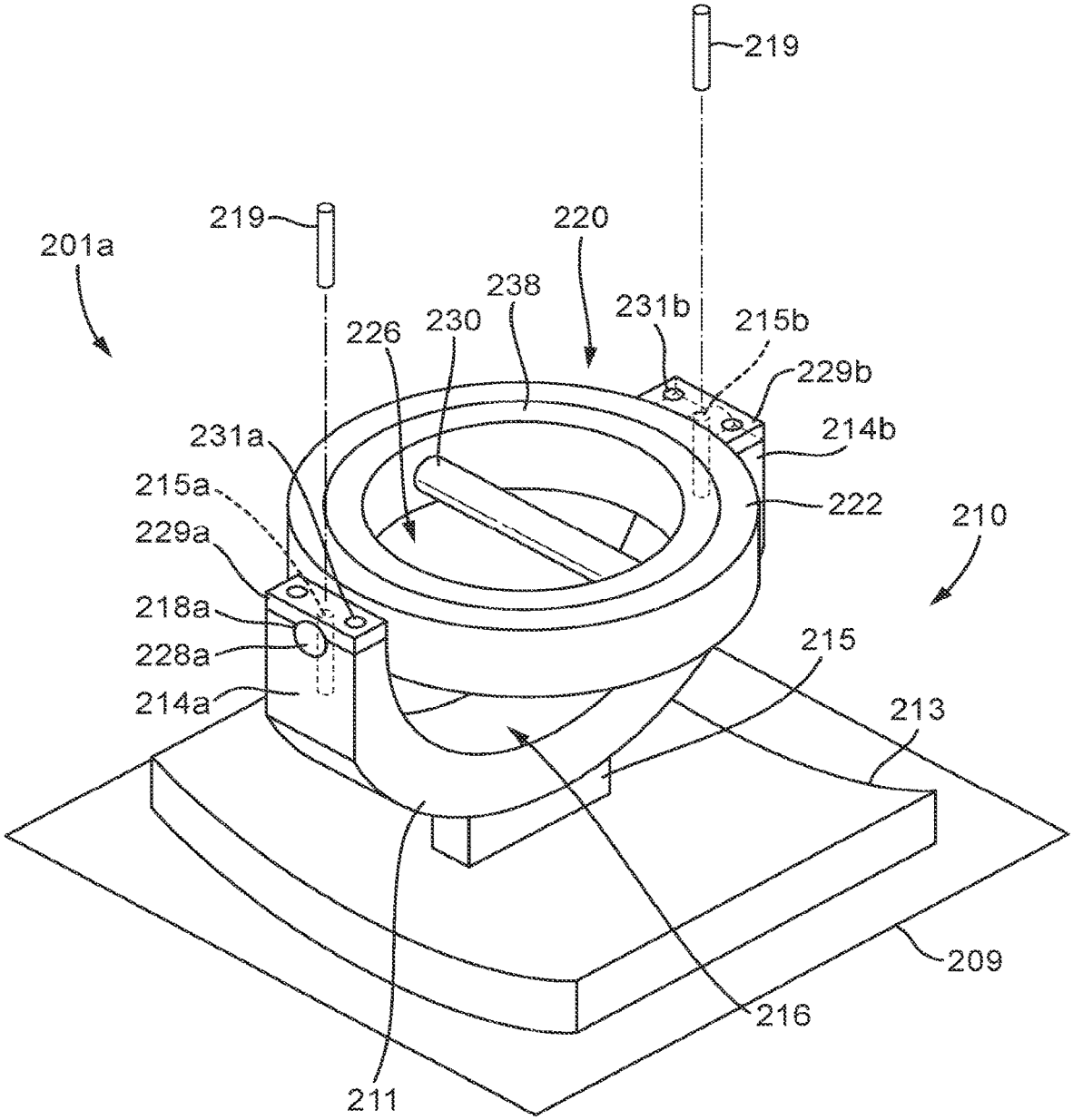
FIG. 3A is a perspective view of a top portion of another embodiment of an exercise device.
Figure 3B:
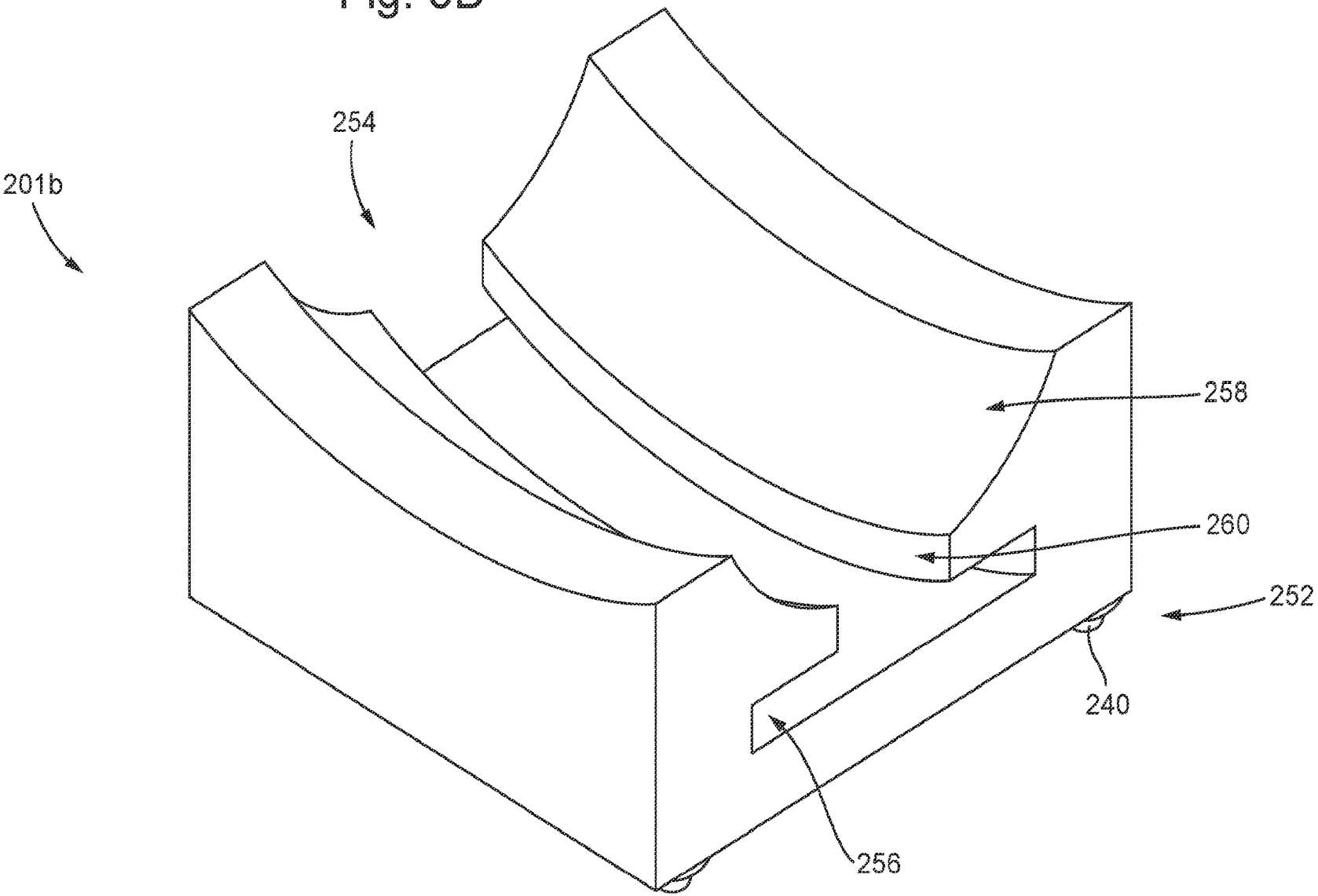
FIG. 3B is a perspective view of a bottom portion or stand of the other embodiment of the exercise device of FIG. 3A.

With reference to an alternative embodiment depicted in FIGS. 3A and 3B, collectively FIG. 3, an exercise device 201 comprises a top portion 201 *a* and a stand 201*b*.

The exercise device 201 is largely analogous to the exercise device 101. For example, the handle 220 is rotatably coupled to the base 210 by means of a first pair of bearings, and the grip 230 is rotatably coupled to the handle 220 by means of a second pair of bearings. The top portion 201 *a* is insertable within the stand 201*b*. The top portion 201 *a* is optionally usable without, and independently of, the stand 202*a*.

The exercise device 201 differs from the device 101 in that the rail 213 and the recess 254 are arcuate. The radius of curvature of the arcuate cross section of the rail 213 corresponds to the radius of the curvature of the arcuate cross section of the channel 256, such that the rail 213 may be slidable within the channel 256. In an example not shown, the rail 213 and the channel 256 may alternatively be hemispherical. Of course, other shapes and configurations are readily ascertainable and envisioned herein.

The rail 213 is optionally shorter in length than the channel 256. For example, the rail 213 may be approximately half of the length of the channel 256. The rail 213 is slidable along the channel 256, such that the top portion 201 *a* can slide along an arcuate path relative to the stand 201 *b*, so that as the rail 213 slides along the channel 256, the inclination of the top portion 201*a* to the vertical, will change. As with the stand 101*b*, the stand 201 *b* may comprises feet 240 which may comprise rotatable elements 240.

In a first mode of use, the top portion 201*a* is used without the stand 201*b*. The surface-engaging face 212 of the arcuate rail 213 is placed on a surface 209 (e.g., floor, wall, etc.) against which the device 201 is to be used. A user of the device 201 may then use the device 201 in the same manner as the device 101. For example, the user may grasp the grip 230 in order to perform an exercise (e.g., press-ups, dips, etc.) The rotational freedom and mobility of the grip 230 and the handle 220 promotes the recruitment and training of stabilizer muscles of the user, because these stabilizer muscles must be used to control the position and orientation of the grip 230 and the handle 220. Further, the arcuate rail 213 of the top portion 201*a* allows the whole of the top portion 201*a* to tilt according to which part of the arcuate rail is in contact with the surface 209 on which the top portion is used. For example, as the direction and magnitude of the forces exerted through the grip 230 vary during performance of an exercise, the top portion 201*a* will tilt or rock back and forth along the arcuate rail 213. This tilting motion further promotes the recruitment and training of stabilizer muscles of the user in order to maintain the top portion 201*a* in a stable and/or fixed position and orientation, and also allows a degree of movement as the angle of the hands changes relative to a user's body over the full range of movement during a repetition of, for example, a push up. This may ease pressure on the user's wrists making the exercise device more comfortable to use.

In a second, alternative, mode of use, the top portion 201*a* may be received in the stand 201*b* such that the top portion 201*a* and the stand 201*b* are interconnected and used together. This is achieved by inserting the arcuate rail 213 of the top portion 201*a* into the arcuate channel 256 of the stand 201 *b*. A user of the device 201 may then use the device in the same manner as the second mode of use of the exercise device 101. For example, the user may grasp the grip 230 in order to perform an exercise. The rotational freedom and mobility of the grip 230 and the handle member 220 promotes the recruitment and training of stabilizer muscles of the user. As the angle of the force exerted by the user on the grip 230 varies during performance of an exercise, the arcuate rail 213 slides within the arcuate channel 256, such that the angle of the top portion 201 *a* relative to the stand 201*b*, and thus the surface 209 on which the device is placed, varies. This confers yet further training stimuli on the stabilizer muscles of the user's upper body. Accordingly, a user may select the second mode of use over the first mode of use in order to provide additional training stimuli.

As described in relation to the exercise device 101, the exercise device 201 may comprise an adjustment element for each of the dynamic features (e.g., features on the device 201 which comprise components which move, articulate or rotate during use). These dynamic features, for example, comprise the bearing assemblies between the base 210 and the handle 220, and the bearing assemblies between handle 220 and the grip 230, and each of these dynamic features may comprise an adjustment element. Further, the rotatable elements 140 may each, or collectively, comprise an adjustment element. The adjustment element allows a user of the device 201 to selectively adjust the resistance or friction settings (e.g., on, off and within a predetermined range of movement) of each of the above dynamic features. For example, the adjustment element may allow the user to "lock" a particular dynamic feature, such that the feature cannot rotate when locked. The adjustment element may allow the user to control the resistance of each of the bearing arrangements or rotatable elements to determine the degree of stabilizer muscle recruitment and training during performance of an exercise. Each adjustment element may, for example, comprise a pin insertable through corresponding bores in the bearing. When the pin is inserted through the bearing, the bearing is prevented from rotating. If a plurality of bores are formed in the bearing at different angular positions, the pin can be used to lock the bearing in any one of a predetermined number of angular positions.

Similarly, the channel 256 may comprise a plurality of stops to control the range of sliding motion of the rail 213 in the channel 256. For example, the channel 256 may comprise a series of bores provided at regular intervals along the channel 256 such that the user may insert pins in selected bores to lock the rail in a particular position along the channel 256, or alternatively to define limits between which the rail 213 may be permitted to slide. In this manner, a user of the device 201 can gradually increase the complexity and variability of the exercise such that his/her stabilizer muscles may be trained gradually and proportionately to their existing physique.

Other embodiments of the invention will be apparent to those skilled in the art from consideration of the specification and practice of the invention disclosed herein. It is intended that the embodiments described above be considered as exemplary only, with a true scope and spirit of the invention being indicated by the appended claims. Moreover, none of the features disclosed in this specification should be construed as essential elements, and therefore, no disclosed features should be construed as being part of the claimed invention unless the features are specifically recited in the claims. It will be understood that any of the features disclosed on any particular embodiment may be incorporated in whole or in part on any of the other disclosed embodiments.

What is claimed is:

1. An exercise device comprising:

a base including a first support strut, a second support strut, and a bridge member interconnecting the first and second support struts and having a planar surface-engaging face configured to engage a surface on or against which the exercise device is used; and a handle having a first end and a second end opposite to said first end, a grip, an inner ring in which the grip is rotatably mounted, and an outer ring in which the inner ring is rotatably mounted, the handle being rotatably coupled to the base via a first bearing at the first end of the handle and a second bearing at the second end of the handle;

wherein the first bearing and the second bearing of the handle define a first axis about which the handle is configured to rotate relative to the base, the first axis being parallel with the surface;

wherein at least one of the first bearing and the second bearing comprises an adjustment element configured to selectively limit a degree of rotation of the handle about the first axis; and wherein one of the inner ring and the outer ring comprises an annular rail which is captive within a slot formed in the other of the inner ring and the outer ring, the annular rail being sized to slide freely around the slot about a second axis.

2. The exercise device of claim 1, wherein the inner ring rotates in the outer ring about the second axis which is perpendicular to the first axis.

3. The exercise device of claim 2, wherein the inner ring comprises a second adjustment element which limits a degree of rotation of the grip about the second axis.

4. The exercise device of claim 1, further comprising a stand which supports the base, the base being mounted in the stand.

5. The exercise device of claim 4, wherein the stand includes a recess which opens into a channel, wherein the recess and the channel are sized to cooperatively receive the first and second support struts of the base.

6. The exercise device of claim 4, wherein the stand includes a plurality of rotatable elements which are configured to engage the surface and facilitate movement of the exercise device over the surface.

7. The exercise device of claim 6, wherein the plurality of rotatable elements are selected from the group consisting of wheels, ball rollers and castors.

8. The exercise device of claim 1, wherein the annular rail has a substantially planar, uniform cross section.

9. The exercise device of claim 8, wherein the recess and the channel are sized is rectangular.

10. The exercise device of claim 1, wherein the annular rail includes a support face on a lowermost surface of the annular rail.

11. The exercise device of claim 1, further comprising a web, the web configured to join the annular rail to a remainder of the base, and to the first and second support struts.

12. An exercise device comprising:

a base including a first support strut, a second support strut, and a bridge member interconnecting the first and second support struts and having a planar surface-engaging face configured to engage a surface on or against which the exercise device is used; and a handle having a first end and a second end opposite to said first end, a grip, an inner ring in which the grip is rotatably mounted, and an outer ring in which the inner ring is rotatably mounted, the handle being rotatably coupled to the base via a first bearing at the first end of the handle and a second bearing at the second end of the handle;

wherein the first bearing and the second bearing of the handle define a first axis about which the handle is configured to rotate relative to the base, the first axis being parallel with the surface;

wherein at least one of the first bearing and the second bearing comprises a first adjustment element configured to selectively limit a degree of rotation of the handle about the first axis;

wherein the inner ring rotates in the outer ring about a second axis which is perpendicular to the first axis;

wherein one of the inner ring and the outer ring comprises an annular rail which is captive within a slot formed in the other of the inner ring and the outer ring, the annular rail being sized to slide freely around the slot about the second axis; and wherein the inner ring comprises a second adjustment element which limits a degree of rotation of the grip about the second axis.

13. The exercise device of claim 12, further comprising a stand which supports the base, the base being mounted in the stand.

14. The exercise device of claim 13, wherein the stand includes a recess which opens into a channel, wherein the substantially planar, uniform cross section of the annular rail to cooperatively receive the first and second support struts of the base.

15. The exercise device of claim 12, wherein the annular rail includes a support face on a lowermost surface of the annular rail.

16. The exercise device of claim 12, further comprising a web, the web configured to join the annular rail to a remainder of the base, and to the first and second support struts.

17. An exercise device comprising:

a base including a first support strut, a second support strut, and a bridge member interconnecting the first and second support struts and having a planar surface-engaging face configured to engage a surface on or against which the exercise device is used;

a handle having a first end and a second end opposite to said first end, a grip, an inner ring in which the grip is rotatably mounted, and an outer ring in which the inner ring is rotatably mounted, the handle being rotatably coupled to the base via a first bearing at the first end of the handle and a second bearing at the second end of the handle; and a web, the web configured to join an annular rail to a remainder of the base, and to the first and second support struts;

wherein the first bearing and the second bearing of the handle define a first axis about which the handle is configured to rotate relative to the base, the first axis being parallel with the surface;

wherein at least one of the first bearing and the second bearing comprises an adjustment element configured to selectively limit a degree of rotation of the handle about the first axis; and wherein one of the inner ring and the outer ring comprises an annular rail which is captive within a slot formed in the other of the inner ring and the outer ring, the annular rail being sized to slide freely around the slot about a second axis.

18. The exercise device of claim 17, wherein the inner ring rotates in the outer ring about the second axis which is perpendicular to the first axis, and wherein the inner ring comprises a second adjustment element which limits a degree of rotation of the grip about the second axis.

* * * * *